United States Patent [19]

Undin

[11] 4,057,993

[45] Nov. 15, 1977

[54] HAND OPERATED GRIPPING APPARATUS

[75] Inventor: Hans Undin, Akersberg, Sweden

[73] Assignee: Pressmaster, Ltd., Stockholm, Sweden

[21] Appl. No.: 659,331

[22] Filed: Feb. 19, 1976

[30] Foreign Application Priority Data

Mar. 25, 1975 Sweden ..... 7503488

[51] Int. Cl.[2] ..... B21D 9/08

[52] U.S. Cl. ..... 72/410; 29/751; 29/758; 81/5.1 R

[58] Field of Search ..... 72/409, 410; 81/313, 81/5.1 R; 269/95, 96, 97, 98; 29/203 H, 751, 758

[56] References Cited

U.S. PATENT DOCUMENTS

| | | | |
|---|---|---|---|
| 274,232 | 3/1883 | Thayer et al. | 269/97 X |
| 1,142,617 | 6/1917 | Patterson | 269/96 |
| 1,365,344 | 1/1921 | Rosenberg | 269/97 X |
| 2,844,981 | 7/1958 | Steine | 269/98 X |
| 2,971,411 | 2/1961 | Dull | 269/96 X |
| 3,024,018 | 3/1962 | Manz | 269/97 X |

FOREIGN PATENT DOCUMENTS

| | | | |
|---|---|---|---|
| 922,069 | 1/1947 | France | 269/97 |
| 1,332,711 | 10/1973 | United Kingdom | 269/96 |

*Primary Examiner*—Leon Gilden

*Attorney, Agent, or Firm*—Mel K. Silverman; David A. Jackson

[57] ABSTRACT

A manually operable gripping apparatus comprising a portable tool having first and second lever devices pivotally interconnected intermediate therein so as to provide a pair of opposed jaws moveable relative to each other to grip a work piece and a pair of opposed handles moveable relatively to each other to actuate the jaws, a stand for the tool, and coupling means detachably connected to the first lever device of the portable tool to the stand so that the tool forms with the stand, a stationary apparatus operable by movement of the handle of the second lever device of the tool.

12 Claims, 4 Drawing Figures

HAND OPERATED GRIPPING APPARATUS

Figure 1:
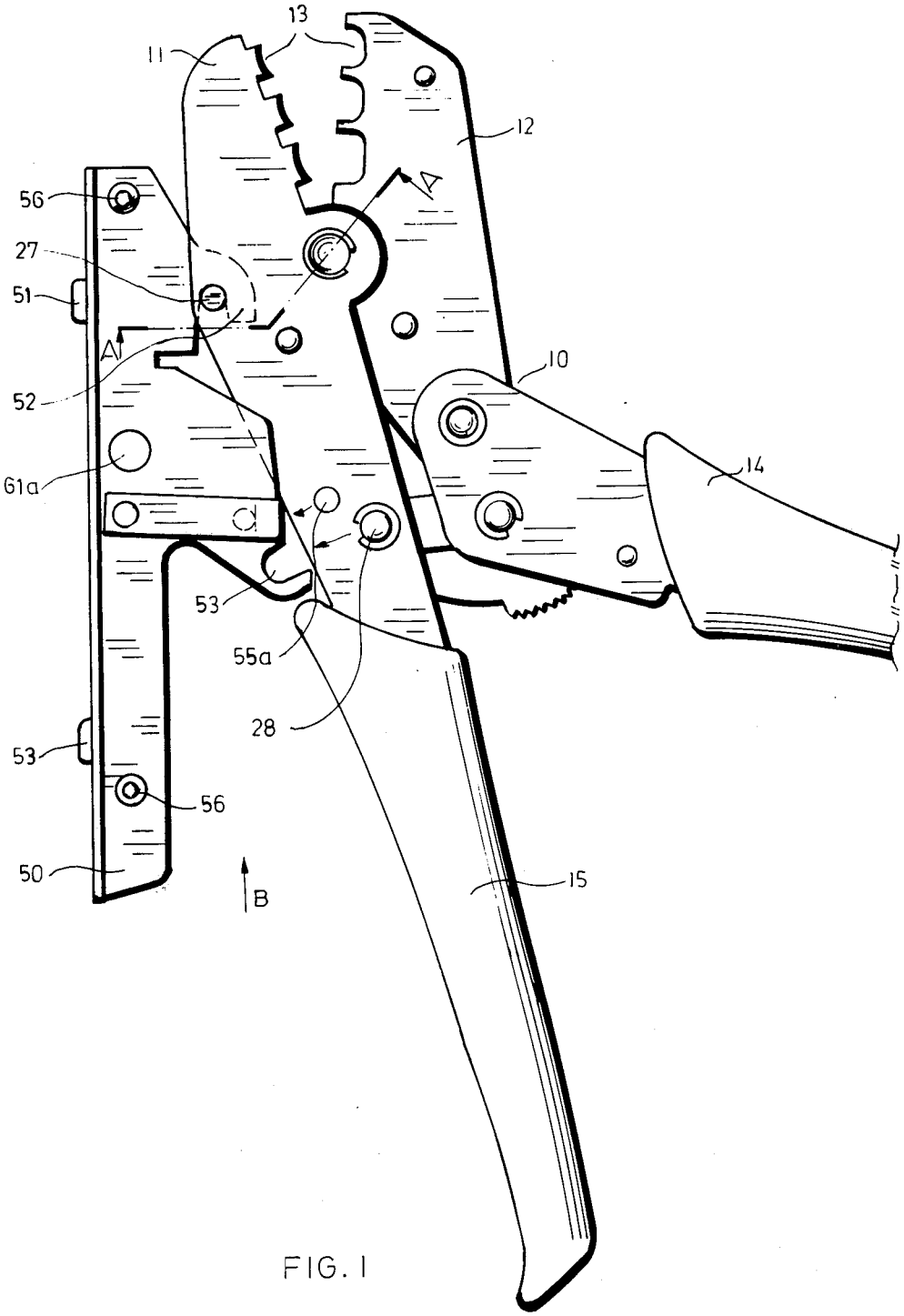

This invention relates to manually operable gripping apparatus and is especially but not exclusively concerned with a hand-operated crimping tool of the pliers type for use in securing electrical cable terminals or the like (hereinafter referred to as ferrules) to the ends of wires and cables by the method known as crimping, by which method a hollow part of the ferrule or crimp barrel is by force squeezed on to the end, e.g. a stripped end, of the cable or wire.

A crimping tool of this type may be similar to conventional pliers, having a couple of relatively pivotable or slidable crimping jaws and a couple of operating handles, except that the jaws are specially shaped for crimping the terminals, i.e. along their inner edges provided with at least one, but usually a series, of cooperating die pairs for cables, so that ferrules of different diameters can be crimped. In transverse cross-section, the cut-outs often show a depressed or even quite empty central area where no engagement between the tool and the ferrule takes place.

Besides these hand tools, larger stationary apparatus for crimping ferrules is known, which is adapted e.g. to be screwed on to a working desk and operated by compressed air or the like.

It is an object of the present invention to create a tool of the aforesaid kind which in order to be convertible to stationary apparatus which can be set up e.g. on a working desk is provided with a detachable stand adapted to engage by suitable formations a part of the tool so that one handle and/or one jaw of the tool is rigidly connected and to the stand which holds the tool fast for operation.

According to the present invention we provide manually operable gripping apparatus, especially ferrule crimping apparatus, comprising a manually operable portable tool having first and second lever devices pivotally interconnected intermediate their ends so as to provide a pair of opposed jaws movable relatively to each other to grip a workpiece and a pair of opposed handles movable relatively to each other to actuate the jaws, a stand for the tool, and coupling means detachably connecting the first lever device of the portable tool to the stand so that the tool forms with the stand a stationary apparatus operable by movement of the handle of the second lever device of the tool.

Further according to the present invention we provide a manually operable portable tool for mounting on a stand, comprising first and second lever devices pivotally interconnected intermediate their ends so as to provide a pair of opposed working jaws movable relatively to each other to grip a workpiece and a pair of opposed handles movable relatively to each other to actuate the jaws, wherein a lever device includes longitudinally spaced pins engageable in corresponding longitudinally spaced open-ended slot means in a stand for the tool, and a recess engageable by a releasable catch on the stand so that the tool is retained against removal from the stand.

Still further according to the present invention we provide a stand for a manually operable portable tool of the kind having first and second lever devices pivotally interconnected intermediate their ends so as to provide a pair of opposed working jaws movable relatively to each other to grip a workpiece and a pair of opposed handles movable relatively to each other to actuate the jaws, said stand comprising base means enabling support of the stand, longitudinally extending upstanding wall means on the base means, first and second longitudinally spaced open-ended slot means formed in the wall means and extending respectively longitudinally and upwardly to receive corresponding pins on a lever device of the tool, and a manually withdrawable spring catch on the wall means engageable with a recess in said lever device to retain the tool on the wall means.

The stand may be provided with at least one hook formation for coupling with an engagement means on the device, with at least one slot means for receiving another engagement means on the device, and with resilient locking means such as a spring having a slanting check surface for engagement in a corresponding depression or hole in the body of the tool.

In an embodiment of the tool where two laterally spaced walls assure an empty central area, seen in transverse cross section, the holding means on the tool for engagement with said hook formation may be a pin extending between the two walls of a jaw part and/or handle part of the tool. On the other hand, the recess or slots in the stand may be adapted to receive outwardly protruding ends of a pivot pin of the tool.

The stand may have a base for resting on a table surface and may be provided with means for enabling temporary secure attachment of the base to the working surface on which it is located, such as suction cups or detachable clamp means.

Alternatively, the stand may be provided with base means for engagement in a vice instead of for resting on a table.

A tool in accordance with the present invention has the obvious advantage of being able to be converted to a more easily operable stationary apparatus when used e.g. in a workshop, while it continues to be a portable device when used for on-the-spot installations.

In a preferred embodiment of the present invention, there are provided on the stand holding means for the workpiece and/or for an auxiliary tool, which otherwise would be disposed on the tool itself, thus offering a simpler tool for mobile operation and a more sophisticated apparatus for stationary use.

Figure 2:
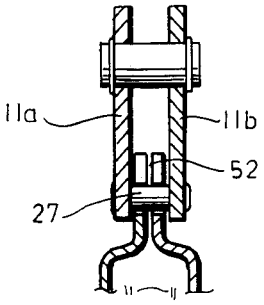
Figure 4:
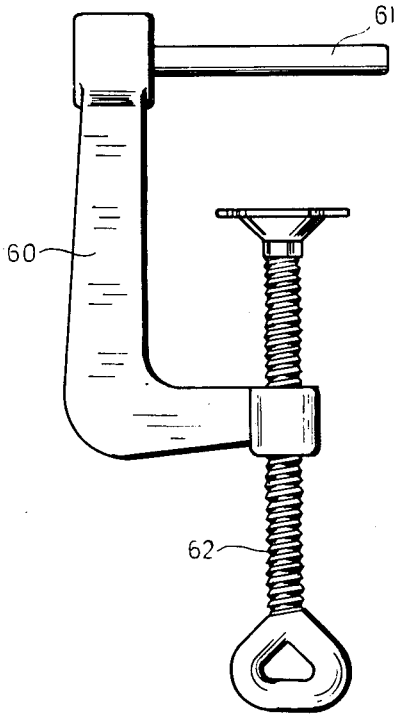
Figure 3:
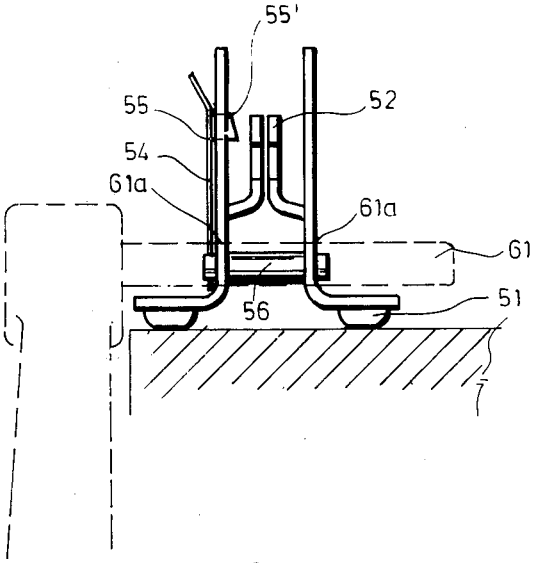

Exemplary embodiments of the present invention will now be described with reference to the accompanying drawings in which:

FIG. 1 is an elevation of apparatus including a tool of the kind specified combined with a detachable stand for use on a table, FIG. 2 is a transverse cross-section of the apparatus along the line A—A of FIG. 1, FIG. 3 is a front view of the table stand of FIGS. 1 and 2 in the direction of arrow B in FIG. 1, and FIG. 4 is an elevation of a detachable vice for the table stand of FIG. 3.

Referring to FIG. 1, the crimping tool 10 of conventional general configuration has basically two limbs or handles 14, 15 and two jaws 11, 12, which are movable towards and away from each other and which are provided with a plurality of different die pairs 13 for ferrules and cables of different diameters. The jaw 11 is rigidly connected with the handle 15.

From FIG. 2 which is a transverse cross-section through the lower jaw 11 along the line A—A in FIG. 1, it is evident that the lower jaw 11 consists of two laterally spaced walls 11*a*, 11*b* between which in conventional tools of this kind space is left. According to a preferred embodiment of the present invention this central space is used to accomodate the coupling means of the stant.

Referring to FIGS. 1 and 3, the stand 50 is provided with four rubber feet 51, 53 (only two of them are seen in each drawing) and has its front end (the upper end in the drawing) a hook formation 52 adapted in its thickness and configuration to engage inside the lower jaw 11 the transverse pivot pin 27 (FIGS. 1 and 2) which holds together the two opposed walls 11*a*, 11*b* of this lower jaw 11. When the tool thus first has been pivotally fixed in the hook 52, it may be rocked until the protruding ends of another transverse pivot pin 28, which also forms the pivotal axis of a functional component of the tool, come to rest in slots or recesses 53 in the stand 50. The tool 10 now rests in an exactly defined position on the stand 50. To secure this position, the stand 50 is on the outside of one of its side walls provided with a leaf spring 54 which at its upper end has thereon a securing block 55 with wedge-shaped contact surface 55. The securing block 55 passes freely through an opening in the adjacent side wall of the stand 50.

The tool 10 is at a location corresponding to the position of the block 55 when the tool is mounted on the stand means 50, provided with an opening 55*a* (FIG. 1) adapted to receive the block 55. It is obvious that when the tool 10 is pressed down into the slots 53, the block 55' will yield due to the wedge shape of its contact surface 55', and will fit into the opening 55*a* as soon as the tool 10 comes to rest in its proper position on the stand 50.

In a preferred embodiment the stand 50 is produced from two sheets of metal approx. 2 mm thick which are given the profiles shown in FIG. 1 and the different parts of which are bent to the cross-sectional shapes which are shown in FIG. 3. Both sheets — each forming one side wall — are held together by distance bolts such as 56 (FIG. 3). However, any other material and any other production method may be applied.

To fix the stand 50 in a chosen position on a working desk, suction cups instead of the feet 51, 53 may for instance be used. Preferably, however, a detachable clamp attachment 60 according to FIG. 4 is used. The clamp's upper part is formed by a rod 61 adapted to be freely inserted into corresponding openings 61*a* (FIG. 3) in the two opposed side walls of the stand 50. The fixing screw 62 of the clamp attachment is then in conventional manner tightened against the underside of the working desk.

Alternatively, the stand can be provided with bottom flange means for fixing between the jaws of a vice. In one example the outwardly bent flanges bearing the feet 51 (FIG. 3) are instead, in a somewhat lengthened form, first bent inwards and then downwards, analogically with the inward and upward bending of the parts forming the hook means 52.

What is claimed is:

1. Manually operable portable tool, especially ferrule crimping apparatus, mountable on a table stand and comprising first and second lever devices interconnected intermediate their ends so as to provide a pair of opposed jaws movable relative to each other to grip a workpiece, and a pair of opposed handles pivotable relatively to each other to actuate the jaws, wherein the first lever device includes at least two longitudinally spaecd tens which are parallel with the pivot axis of the handles and are engagable in corresponding longitudinally spaced open-ended slot means in the stand, so that the tool by the sequential insertion of the said pens in the said slot means forms with the stand a stationary apparatus in which the first lever device extends substantially parallel with a surface on which the stand is set up, and is operable by movement of the handle of the second lever device (of the tool).

2. Tool according to claim 1, comprising locking means including a recess in the first lever device accommodating a catch of the stand.

3. A stand for a manually operable portable tool, especially ferrule crimping pliers, of the kind having first and second lever devices pivotally interconnected intermediate their ends so as to provide a pair of opposed working jaws movable relatively to each other and a pair of opposed handles pivotable relatively to each other to actuate the jaws, wherein the first lever device includes at least two longitudinally spaced pins which are parallel with the pivot axis and engagable in open-ended slot means, said stand comprising base means, enabling support of the stand, longitudinally extending upstanding wall means, first and second longitudinally spaced open-ended slot means formed in the wall means and extending respectively longitudinally and upwardly to receive the said pins on the first lever device of the tool which are parallel with the pivot axis of the tool, so that the tool by the sequential insertion of the said pins in the said slot means can be inserted into the stand to form with the stand a stationary apparatus operable by movement of the handle of the second lever device, the slot means being arranged in such a manner that the tool rests in the stand with at least one of its handles substantially parallel with a support surface carrying the base means of the stand.

4. Stand according to claim 3, including locking means defined by a manually withdrawable catch on the stand yieldingly urged to a position in which the first lever device is locked against removal from the stand.

5. Stand according to claim 3, including fastening means on the base means for releasably attaching a base means to the bracket said top surface.

6. Stand according to claim 3, including depending base flange means for engagement between the jaws of a supporting vice.

7. Stand according to claim 3 in which the open-ended slot means extending longitudinally are arranged nearer the end of the stand to which the jaw end of the inserted tool is closer, and the upwardly extending open-ended slot means are arranged nearer the other end of the stand.

8. Stand according to claim 3 for a tool of the kind specified in which at least the first lever device with the said longitudinally spaced pins in at least one part thereof is made of a pair of spaced plates defining side wall means, and at least one of the said pins bridges the empty central area between the side wall means, wherein at least one of the said open-ended slot means is adapted for engagement of the respective pin in the said empty central area between the side wall means, wherein at least one of the said open-ended slot means is adapted for engagement of the respective pin in the said empty central area between the side wall means of the tool.

9. Stand according to claim 3 wherein the upstanding wall means include a pair of laterally spaced upstanding plates and at least one of the open-ended slot means has the form of a pair of substantially identical and juxtaposed slots, one in each of the said plates, which are arranged to receive pivot ends laterally protruding from the tool.

10. Stand according to claim 9, wherein the upwardly extending open-ended slot means is arranged in the said manner.

11. Stand according to claim 4, wherein the catch has a wedge face so as to be movable to release position by the tool in mounting the tool on the stand.

12. Stand according to claim 3, including beyond the open-ended slot means a base portion extending at least partially under the handle end of an inserted tool.

* * * * *